US005217294A

United States Patent [19]

Liston

[11] Patent Number: 5,217,294

[45] Date of Patent: Jun. 8, 1993

[54] HEAD MOUNTED MULTI-POSITION FLASHLIGHT HOLDER

[76] Inventor: John J. Liston, 1923 Wilson Ave., Salt Lake City, Utah 84108

[21] Appl. No.: 917,501

[22] Filed: Jul. 21, 1992

[51] Int. Cl.[5] ..... F21C 15/14

[52] U.S. Cl. ..... 362/105; 362/190

[58] Field of Search ..... 362/103, 105, 106, 190, 362/191

[56] References Cited

U.S. PATENT DOCUMENTS

| | | | |
|---|---|---|---|
| 1,318,850 | 10/1919 | DeYong . | |
| 1,530,402 | 3/1925 | Parker | 362/105 |
| 1,540,372 | 6/1925 | Sears . | |
| 1,904,402 | 4/1933 | Pratt | 362/105 |
| 2,263,577 | 11/1941 | Griner . | |
| 3,240,271 | 5/1966 | Allbritton . | |
| 3,542,041 | 11/1970 | Mercorella . | |
| 3,634,676 | 1/1972 | Castellano . | |
| 3,769,663 | 11/1973 | Perl . | |
| 4,236,658 | 12/1980 | Kallman . | |
| 4,360,930 | 11/1982 | Blanchard . | |
| 4,462,064 | 7/1984 | Schweitzer . | |
| 4,462,068 | 7/1984 | Shadwick . | |
| 4,521,831 | 6/1985 | Thayer . | |
| 4,528,622 | 7/1985 | Bacevius . | |
| 4,718,126 | 1/1988 | Slay | 362/105 |
| 4,794,496 | 12/1988 | Lanes et al. | 362/105 |
| 4,797,793 | 1/1989 | Fields . | |
| 4,897,768 | 1/1990 | Thul . | |
| 4,970,631 | 11/1990 | Marshall | 362/105 |
| 4,998,187 | 3/1991 | Herrick . | |
| 5,034,862 | 7/1991 | Liston | 362/191 |
| 5,062,026 | 10/1991 | Maglica et al. . | |

FOREIGN PATENT DOCUMENTS

| | | | |
|---|---|---|---|
| 164541 | 11/1949 | Austria | 362/105 |

*Primary Examiner*—Richard R. Cole

*Attorney, Agent, or Firm*—Thorpe, North & Western

[57] ABSTRACT

A headband for use in holding a flashlight to the side of a user's head. The flashlight is attached to a plate. The plate is releasably attached to the headband. When the user desires to change the orientation of the flashlight, the plate is removed and reattached at the desired orientation. The flashlight can thus be oriented so as to cause the flashlight beam to be directed generally along the user's line of sight or any other desirable axis.

6 Claims, 3 Drawing Sheets

HEAD MOUNTED MULTI-POSITION FLASHLIGHT HOLDER

BACKGROUND OF THE INVENTION

1) Field of the Invention

The present invention relates to a holding device; specifically, a flashlight holding device which is attachable about the head of a user.

2) Background of the Invention

It has been known in the art to provide a flashlight holding apparatus attachable about the user's head for allowing the user to direct the beam of the flashlight by movement of the head only, thus allowing for hands-free operation.

U.S. Pat. No. 4,797,793 to FIELDS and U.S. Pat. No. 4,718,126 to SLAY, show headbands used for retaining flashlights. FIELDS specifically discloses a headband made of elastic material which has its ends sewn together in such a manner that a pocket is formed between the overlap thereof into which a barrel of a flashlight can be inserted. SLAY discloses a strap made of elastic material for encircling the head. The strap having affixed therearound a broad band which is arranged so as to define a hole therebetween and the strap into which the barrel of the flashlight may be inserted.

It has been a problem in the past with prior art headband type flashlight holders to correctly orient the flashlight in the headband so as to both allow the headband to be comfortably placed around the head, and also allow the beam of the flashlight to shine the desired direction. Prior art attempts to solve this problem have resulted in flashlight retaining arrangements which are of complicated and unsatisfactorily effective construction. Examples of adjustable headband type holders are U.S. Pat. No. 1,318,850. None of these prior art flashlight retaining arrangements is as efficient as the multi-positioned flashlight retaining headband of the present invention described below.

SUMMARY OF THE INVENTION

It is an object of the present invention to devise a tool holder which is attachable to a user's head.

Is another object of the present invention to provide a flashlight holder which allows for attachment of a flashlight thereto in a plurality of orientations.

It is a further object of the present invention to provide a holder capable of securely holding a flashlight next to a user's head in any planar orientation desired by the user to allow the flashlight to shine in a direction most convenient to the user.

It is another object of the present invention to provide a flashlight holder as explained above which is simple in design and inexpensive to manufacture.

It is a further object of the present invention to provide a flashlight holder as defined above which is also adaptable to a wide range of head sizes.

It is a still further object of the present invention to provide a flashlight holder that is lightweight, small in size, easily adjustable, and easy to use.

These and other objects are realized in an embodiment of the invention specifically described below which includes an apparatus which holds a tool such as a flashlight about the user's head, the apparatus comprising an elongated strap which is intended to encircle the user's head so as to pass therearound above the eyes at the level of the user's forehead and slightly above the user's ears, the elongated strap being made of an elastic material which allows it to stretch along its length but prevents stretching along its width, the ends of the elongated bands including hook and pile type fastening material such as Velcro or elasticized Velcro; and a strap or set of straps attached approximately at the central regions of the headband on one side thereof, the strap or straps being formed of an elastic material, each end of each strap being sewed or attached by means of a VELCRO covered plate to the headband, each strap thereby being stretchable to form an opening, either entirely of itself or in conjunction with the headband or plate, through which the barrel of a flashlight may be inserted; the opening formed by each strap, if desired, having a longitudinal axis which coincides with the longitudinal axis of an opening in at least one other strap, such coinciding straps constituting a strap set which functions to hold the barrel of a flashlight in a predetermined orientation, the headband allowing a plurality of these straps or strap sets to be included thereon; each strap or straps having the longitudinal axis defined by the openings in the straps thereof and the longitudinal axis of each strap set being oriented differently than that of each other strap set, the headband also being capable of including single straps which are interlocated between strap sets if desired.

The present invention is used by inserting a barrel of a flashlight into a strap or strap set, thus fixing the flashlight in a predetermined orientation relative to the headband, the headband being placed around the user's head such that the flashlight will be located approximately above one of the user's ears so as to be able to shine in a direction approximately parallel with the user's line of sight, the ends of the headband meeting approximately over the user's opposite ear and being attached together by the hook and pile fastening material.

In one preferred embodiment of the present invention, should the user desire the flashlight to be reoriented so that the flashlight is capable of shining in a direction parallel to a different line of sight, the user may reorient the flashlight by separating the hook and pile mounted plate from the headband and reorienting the plate relative thereto before reattaching it. The user is thus able to reorient the flashlight while the headband remains in its original orientation and location on the user's head. The ability to reorient the flashlight in any line of sight planar direction without removing or adjusting the headband.

The design of the present invention allows the user to reorient the flashlight while avoiding the need to move the headband so that the flashlight remains located over the user's ear. Thus the flashlight remains capable of shining in a direction parallel to the user's line of sight without the need to readjust the headband on the head.

These and other objects, advantages and features of the invention will become apparent from the following description of a preferred embodiment, considered along with the accompanying drawings in which like numerals represent similar elements in each drawing.

DETAILED DESCRIPTION OF THE PREFERRED EMBODIMENT

Figure 1:
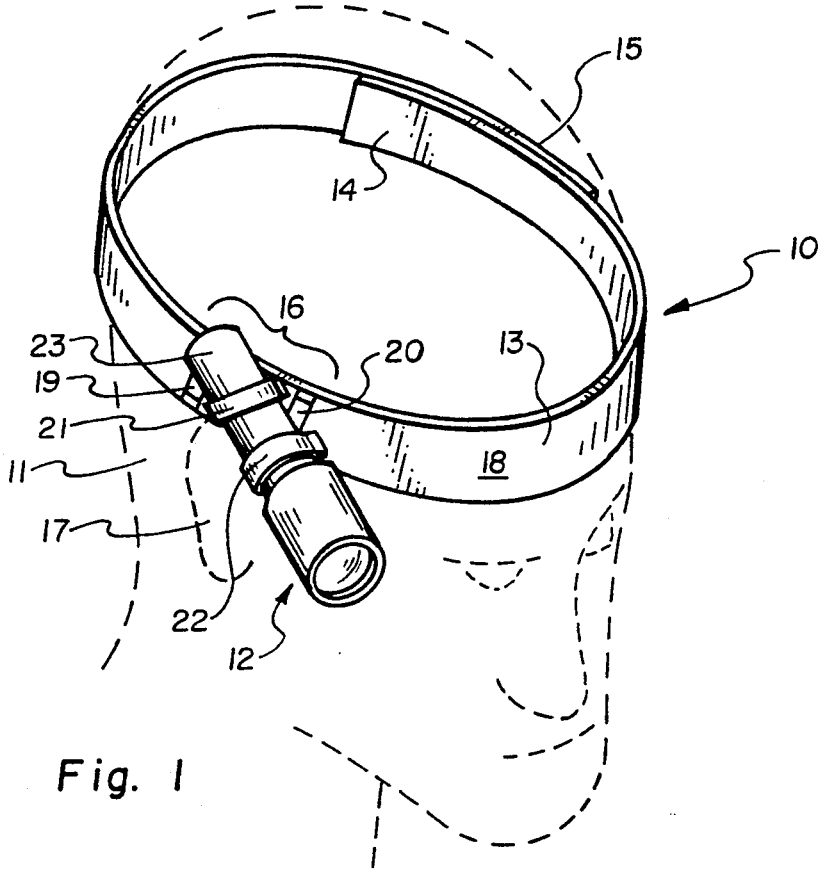
FIG. 1 is a perspective view of a flashlight holder being worn on a user's head.

FIG. 1 shows the tool holding apparatus 10 of the present invention positioned around the head 11 of the user. The tool holding apparatus 10 includes a headband 13 formed in an elongated rectangular shape and including a first end 14 and a second end 15 which are adjustably attachable together to fit the headband 13 to the user's head 11. The headband 13 is formed of a stretchable or elasticized material if desired to ensure a snug fit about the user's head 11. Preferably, the elasticized material allows headband 13 to stretch in its elongated direction, but is not stretchable in the direction of the width thereof.

The headband 13 has a central section 16 which is located generally halfway between the first and second ends 14 and 15 thereof. The central section 16 is intended to be located directly above one of the user's ears 17 when the apparatus 10 is correctly fitted in place on the user's head 11. Within the central section 16, on the outer surface 18 of the headband 13, a plurality of straps 19, 20, 21 and 22 are attached as by sewing or otherwise attaching the ends thereof so as to form a loop or opening. The opening formed may be formed entirely of the strap (such as is shown by the attachment of strap 22) or may be formed partially by the strap and the exterior surface 18 of the headband 13. Straps 19, 20 and 21 are each attached to the exterior surface 18 of the headband 13 in two separate locations thus causing the strap 19, 20 or 21 to form half of the opening and exterior surface 18 to form the other half thereof.

As can be seen in FIG. 1, the straps 21 and 22 are used in conjunction to secure the barrel 23 of a flashlight in the openings formed thereby in such a manner that the lens 24 of the flashlight can shine generally in the direction of the line of sight of the user.

The central axis of the opening formed by strap 22 is aligned with the central axis of the opening partially formed by strap 21. Because the openings of straps 21 and 22 are in such alignment, the linear cylindrical-shape barrel 23 of the flashlight 12 can be passed through both of the openings thus allowing straps 21 and 22 to function as a set. The set of straps 21 and 22 causing the flashlight to be oriented so as to shine in a direction which coincides with the central axis of the openings formed thereby.

Straps 19 and 20 also operate as a set and form openings having coinciding central axis through which the barrel 23 of flashlight 12 may be inserted to cause the flashlight 12 to shine along the central axis defined by the straps 19 and 20.

Figure 2:
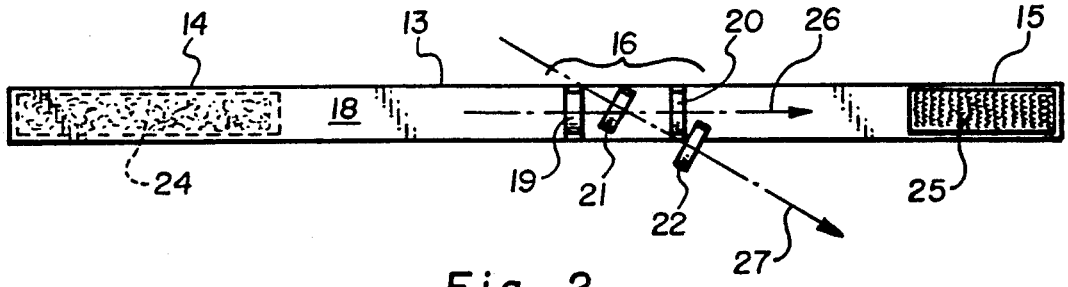
FIG. 2 is a plan view of the headband represented in FIG. 1.

As can be seen in FIG. 2, ends 14 and 15 of the headband 13 may have attached thereto the well-known type hook and pile fastening members 2 and 25. The hook and pile fastening members 24 and 25 may also be formed of an elasticized material if desired.

The central axes of the openings formed by straps 19 and 20 are collinear and shown by arrow 26. As can be seen, the arrow 26 of straps 19 and 20 is directed along the longitudinal axis of the band 13. The central axes of the openings formed by straps 21 and 22 are also collinear and are shown by arrow 27. As can be seen, the strap set which includes straps 21 and 22 will direct the beam of a flashlight 12 at an angle from the longitudinal axis of band 13.

Although the band 13 is shown attached to head 11 of the user such that the central portion 16 thereof is located slightly above the user's right ear 17, it is of course to be understood that the band 13 may be rotated 180 degrees if desired to place the central section 16 over the user's left ear, or the band may be turned upside down with the central section 16 being located above either ear of the user and causing a 180 degree reorientation of arrow 27 representing the longitudinal axes of straps 21 and 22.

Therefore, as can be readily seen, even though only two strap sets are shown on the apparatus 10, the two strap sets may nevertheless function to secure a flashlight 12 to the user's head 11 in more than only two orientations.

Figure 3:
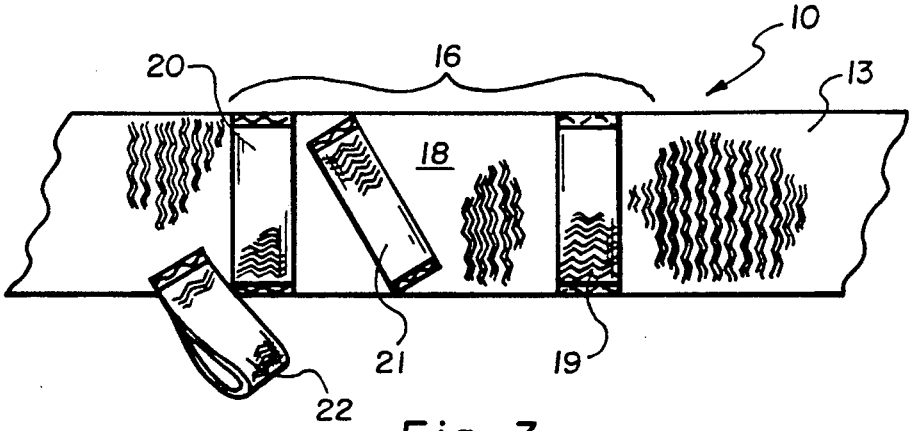
FIG. 3 is a partial plan view of the central portion of the headband represented in FIG. 1.

Referring now to FIG. 3 wherein the central section 16 of the headband 13 is shown, it is important to note that due to the relatively small width of each strap 19, 20, 21 and 22, a strap of one strap set may be attached to the exterior surface 18 of the headband at a location between straps, such as straps 19 and 20, of a second strap set. A third strap set, if so desired, could be attached to the exterior surface 18 of the headband 13 in the central section 16 thereof in such a manner that individual straps of the third strap set were located between individual straps of either of the other strap sets as previously defined. Also, single straps, not constituting a portion of any strap set, may be located between individual straps of a strap set if so desired.

This unique ability of the present invention allows several strap sets or individual straps to be located in approximately the same position in the central section 16. Each individual strap or strap set being able to orient a flashlight when placed therein, differently than the orientation of any other strap or strap set.

Figure 4:
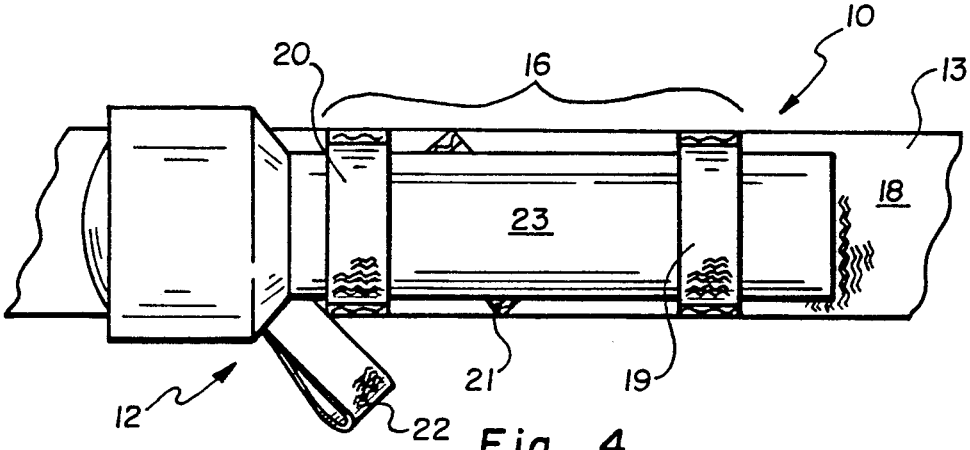
FIG. 4 is a partial plan view of the central portion of the headband represented in FIG. 1 including a flashlight affixed thereto by a band set.
Figure 5:
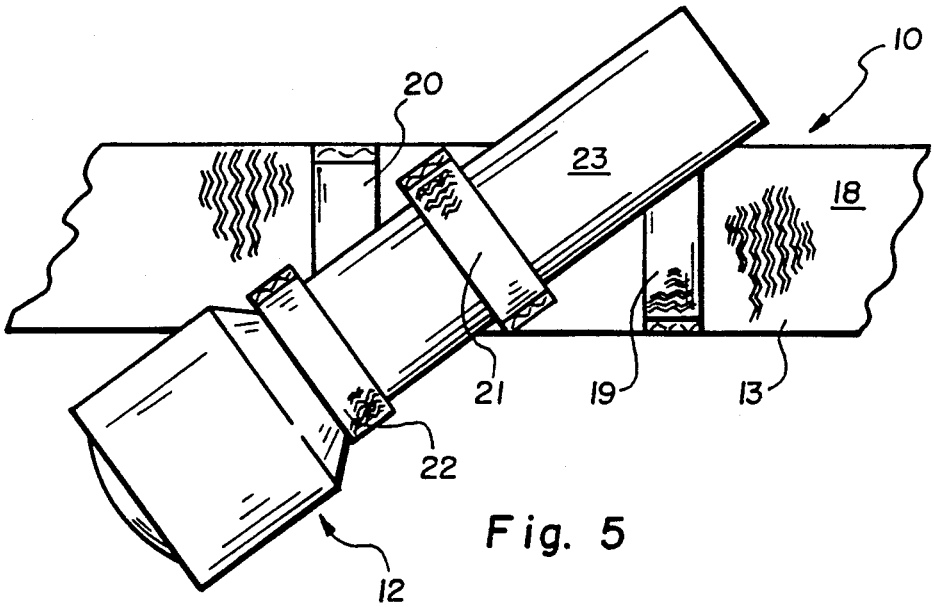
FIG. 5 is a partial plan view of the central portion of the headband represented in FIG. 1 having a flashlight located in a second set of straps.

Further, as is best seen in FIGS. 4 and 5, a strap or strap set which is not in use, meaning a strap or strap set which is not being used to secure the barrel 23 of a flashlight 12 therein, does not interfere with the flashlight 12 or the strap or strap set which is being used.

Specifically, as seen in FIG. 4, the strap set including straps 19 and 20 is being used to orient the flashlight 12 along the longitudinal axis of the headband 13. Even though strap 21 is located between straps 19 and 20, it is nevertheless not used. Instead, strap 21 is pushed flat against the exterior surface 18 of the band 13 by the barrel 23 of the flashlight 12 and causes no interference.

FIG. 5 shows flashlight 12 inserted in the strap set which includes straps 21 and 22. Again, the barrel 23 of the flashlight 12 pushes against straps 19 and 20 to cause them to lie flush against exterior surface 18 of the band 13. Alternatively, if strap 22 was not present, strap 21 would be used as the only strap to orient the flashlight in its predetermined direction if so desired.

Since several straps or strap sets may be attached to the central section 16 of the band 13 in approximately the same location, a user may reorient the direction of the beam of the flashlight 12 without significantly changing the relative location of attachment of the flashlight 12 along the exterior surface 18 of the band 13. This avoids any necessity of readjusting the headband to keep the flashlight in its proper general position on the side of the user's head 11.

Figure 6:
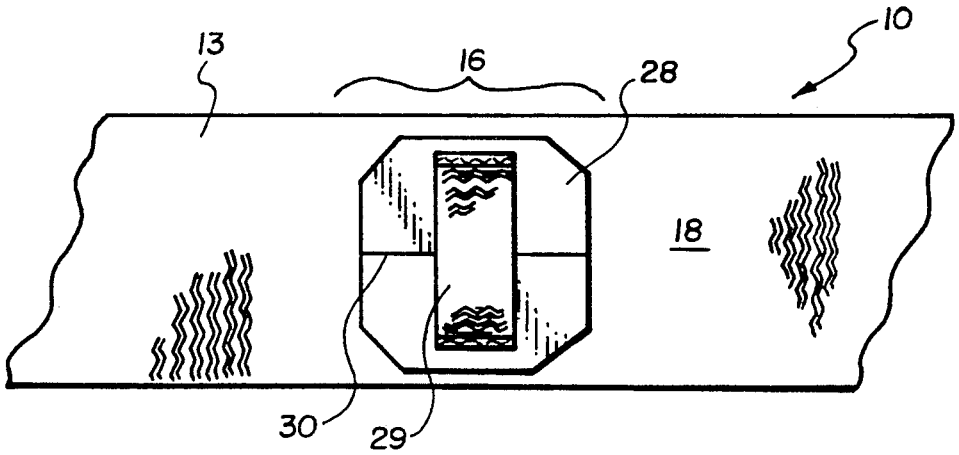
FIG. 6 is a partial plan view of the central portion of a headband formed in accordance with the present invention.
Figure 7:
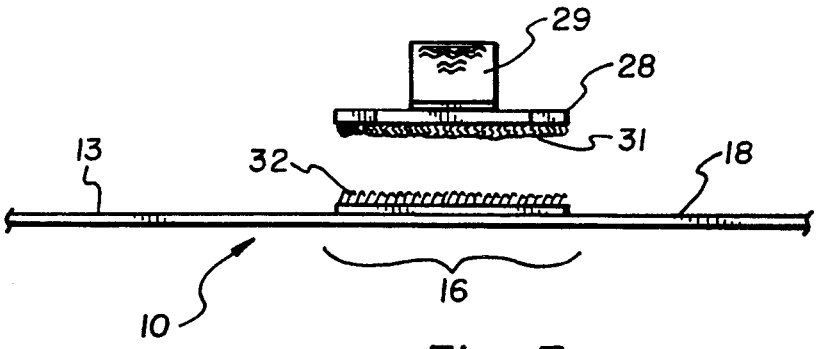
FIG. 7 is a side view of the headband as shown in FIG. 6 with the hook and pile fastener in a separated position.

FIGS. 6 and 7 show the preferred embodiment of the apparatus of the present invention. In this illustrated embodiment, instead of having straps sewn directly to the exterior surface 18 of the headband 13, a plate 28 is attached to the exterior surface 18 by means of hook and pile fasteners such as available under the trademark VELCRO. The plate 28 than has attached thereto a strap 29 in the fashion as described above. A flashlight 12 is inserted into the strap 29 and held tightly against the plate 28. If desired, a crease such as shown at 30 in FIG. 6 may be formed in the plate 28 in order to provide a slight V-shaped configuration in order to conform to the shape of the flashlight 12. It will be appreciated that the plate, or plate means, can be any suitable structure. The plate structure will preferably be rigid but non-rigid structures can also be used within the scope of the present invention.

A plurality of hook fasteners 32 are attached to the exterior surface 18 of the headband 13 at the central portion 16 thereof in any conventional manner such as by sewing. A plurality of loop fasteners 31 are attached to the bottom surface of plate 28 in any conventional manner such as gluing or sewing. In use, the hook fasteners 32 and loop fasteners 31 are pressed together to firmly attach the plate 28 to the headband 13. It will be appreciated that releasable fastening structures other than hook and pile fasteners can be used as a releasable fastening means of the present invention.

Still referring to FIG. 6, a flashlight barrel (not represented) is preferably inserted into strap 29 such that the longitudinal axis of the flashlight extends along the longitudinal axis of the headband 13. However, should the user decide to reorient the beam of the flashlight, the user need merely remove plate 28 by separating the hook fasteners 31 from the pile fasteners 32, and then rotating the plate 28 to the desired orientation relative to headband 13 and then reattaching the plate 28. As can be seen, there is no need to remove the flashlight 12 from its attachment in strap 29 in order to cause a reorientation thereof.

It would be considered within the scope of the presen application, although not specifically shown in FIG. 6 and 7, to have a plurality of straps 29 attached to a single plate 28 in spaced-apart relationship so as to allow attachment of a flashlight thereto in the manner as described above with strap sets. Also, it is within the scope of the present invention to attach a plurality of plates 28 to a headband 13 and to use the straps 29 located on each plate 28 either separately or in conjunction so as to form a strap set.

It is to be understood that the above-described arrangements are only illustrative of the application of the principles of the present invention. Numerous modifications and alternative arrangements may be devised by those skilled in the ar without departing from the spirit and scope of the present invention and the appended claims are intended to cover such modifications and arrangements.

I claim:

1. A holder for use in retaining a flashlight adjacent the head of a user to allow the beam of the flashlight to shine approximately along the user's line of sight, the holder including a headband attachable around the user's head, the improvement comprising:

an elongated band having a central section, a first end, a second end, and exterior face and an interior face, means for releasably attaching said first and second ends of said elongated band, plate means for supporting a flashlight thereon;

releasable fastening means for attaching the plate means to the exterior surface of the elongated band, the releasable fastening means comprising a hook and pile fastener;

means for releasably holding a flashlight on the plate means such that the flashlight may be positioned in any relative planar orientation thereto so as to allow the user to align the beam of the flashlight to shine approximately along the user's line of sight when the headband is attached around the user's head.

2. A holder as defined in claim 1 wherein the means for releasably holding a flashlight comprises at least one strap attached thereto for forming at least one opening sized to encircle a barrel of the flashlight.

3. A holder as defined in claim 1 wherein the elongated band comprises an elongated band of an elasticized material.

4. A holder as defined in claim 1 wherein the means for releasably attaching comprises a hook and pile fastener.

5. A tool holder for use in retaining a flashlight above one ear of a user so as to allow the beam of the flashlight to shine approximately along the user's line of sight, the holder including a headband attachable around the user's head, the improvement comprising:

an elongated band of elasticized material having a central section, a first end, a second end, and exterior face and an interior face, means for attaching said first and second ends of said elongated band, said exterior surface of said central section of said elongated band including a plate means, removably attachable thereto by a fastening means, said plate means being fixed relative to said fastening means and having at least one strap attached thereto for forming at least one opening sized to encircle a barrel of the flashlight, whereby, the flashlight may be inserted into the opening of said at least one strap and said plate means may be attached to said headband in any relative orientation thereto so as to allow the user to align the beam of the flashlight to shine approximately along the user's line of sight when the headband is attached around the user's head with the central section thereof being located above one ear.

6. A tool holder for use in retaining a flashlight above one ear of a user so as to allow the beam of the flashlight to shine approximately along the user's line of sight, the holder including a headband attachable around the user's head, the improvement comprising:

an elongated band of material having a central section, a first end, a second end, and exterior face and an interior face, means for attaching said first and second ends of said elongated band, said exterior surface of said central section of said elongated band including a plate means, removably attachable thereto by a fastening means, said plate means being fixed relative to said fastening means and having at least one strap attached thereto for forming at least one opening sized to encircle a barrel of the flashlight, whereby, the flashlight may be inserted into the opening of said at least one strap and said plate means may be attached to said headband in any relative orientation thereto so as to allow the user to align the beam of the flashlight to shine approximately along the user's line of sight when the headband is attached around the user's head with the central section thereof being located above one ear.

* * * * *